US007931163B2

(12) United States Patent
Von Spreckelsen et al.

(10) Patent No.: US 7,931,163 B2
(45) Date of Patent: Apr. 26, 2011

(54) CAP CLOSURE

(75) Inventors: Henning Von Spreckelsen, Surrey (GB); Peter Michael McGeough, Surrey (GB)

(73) Assignee: Bapco Closures Research Ltd., Surrey (GB)

( * ) Notice: Subject to any disclaimer, the term of this patent is extended or adjusted under 35 U.S.C. 154(b) by 17 days.

(21) Appl. No.: 12/505,227

(22) Filed: Jul. 17, 2009

(65) Prior Publication Data

US 2009/0277859 A1 Nov. 12, 2009

Related U.S. Application Data

(62) Division of application No. 09/701,057, filed as application No. PCT/GB1999/001094 on Apr. 9, 1999, now Pat. No. 7,721,901.

(51) Int. Cl.
*B65D 51/00* (2006.01)

(52) U.S. Cl. ..... 215/232

(58) Field of Classification Search ..... 215/232, 215/45, 44, 43, 305, 295, 228, 347, 341, 215/255, 254, 253, 250, 200; 220/359.4, 220/359.1, 270, 266, 265, 260, 212, 359.3, 220/359.2, 254.2, 254.1, FOR. 186, 200; 53/478, 477, 471, 476, 485, 484, 467; 264/328.1, 264/524, 538, 539, 543; D9/435, 529; D7/629; 222/541.9, 541.1, 541.6, 541.2

See application file for complete search history.

(56) References Cited

U.S. PATENT DOCUMENTS 3,806,300 A 4/1974 Hafele et al.
3,968,823 A 7/1976 Simon
3,990,826 A 11/1976 Marcus
4,141,680 A 2/1979 Kauffman et al.
4,359,169 A * 11/1982 Helms et al. ..... 220/255.1
4,401,231 A 8/1983 Helms
4,682,702 A 7/1987 Gach
4,699,286 A 10/1987 Nolan
4,815,618 A 3/1989 Gach
4,840,289 A 6/1989 Fait et al.
5,004,110 A * 4/1991 Osip et al. ..... 215/232

(Continued)

FOREIGN PATENT DOCUMENTS

CA 2176921 6/1995

(Continued)

OTHER PUBLICATIONS

European Patent Office Decision of the Technical Board of Appeal, decision dated Sep. 30, 2010, mailed on Dec. 2, 2010, Appeal No. T0033/08-3207, 24 pgs.

(Continued)

*Primary Examiner* — Anthony Stashick
*Assistant Examiner* — Robert J Hicks
(74) *Attorney, Agent, or Firm* — K&L Gates LLP

(57) ABSTRACT

A closure for a container having a body comprises a neck and cap assembly with a foil interposed between the body and the neck and cap assembly. The neck comprises a base fitted to the body with a removable annular flange connected to a pull ring and secured to the foil. A frangible region separates the removable annular flange from the base. A plurality of depending teeth each having a saw tooth profile inclined inwardly to a centre of the base are formed in the base adjacent to or in the frangible region such that on removal of the pull ring the foil is torn by the teeth.

6 Claims, 4 Drawing Sheets

U.S. PATENT DOCUMENTS

| | | | | | |
|---|---|---|---|---|---|
| 5,135,702 | A | | 8/1992 | Eales | |
| 5,184,746 | A | | 2/1993 | Moore et al. | |
| 5,297,696 | A | | 3/1994 | Bernstein et al. | |
| 5,465,856 | A | | 11/1995 | Sheffler | |
| 5,680,968 | A | * | 10/1997 | Moore | 222/480 |
| 5,779,088 | A | | 7/1998 | Hornig | |
| 5,858,141 | A | | 1/1999 | Repp et al. | |
| 6,076,334 | A | | 6/2000 | Kitahora et al. | |
| 6,082,568 | A | | 7/2000 | Flanagan | |
| 6,117,506 | A | | 9/2000 | Graboski et al. | |

FOREIGN PATENT DOCUMENTS

| | | | |
|---|---|---|---|
| DE | 43 40553 | A1 | 11/1993 |
| EP | 0126575 | A2 | 8/1984 |
| EP | 0411578 | A1 | 7/1990 |
| EP | 0755871 | A1 | 1/1997 |
| GB | 2108464 | A | 8/1982 |
| GB | 2181419 | A | 4/1987 |
| JP | 54-54552 | | 4/1979 |
| JP | 56-59567 | | 5/1981 |
| JP | 59-155958 | | 10/1984 |
| JP | 61-259903 | | 11/1986 |
| JP | 7-40427 | | 2/1995 |
| JP | 8-324621 | | 12/1996 |
| JP | 10-513157 | | 12/1998 |
| JP | 10513137 | | 12/1998 |
| WO | 96/14249 | | 5/1996 |
| WO | 9623699 | | 8/1996 |
| WO | 96/39329 | | 12/1996 |

OTHER PUBLICATIONS

"Notice of Opposition to a European Patent," papers initiating opposition to European Pat. No. 1080020 which claims the same priority as the present application, May 30, 2006, 24 pages, Beck Greener.

* cited by examiner

FIG. 9
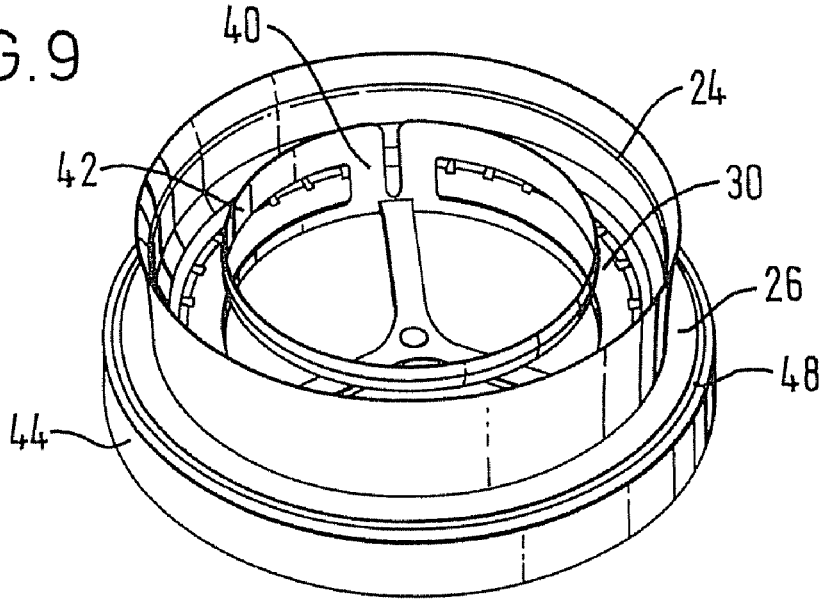
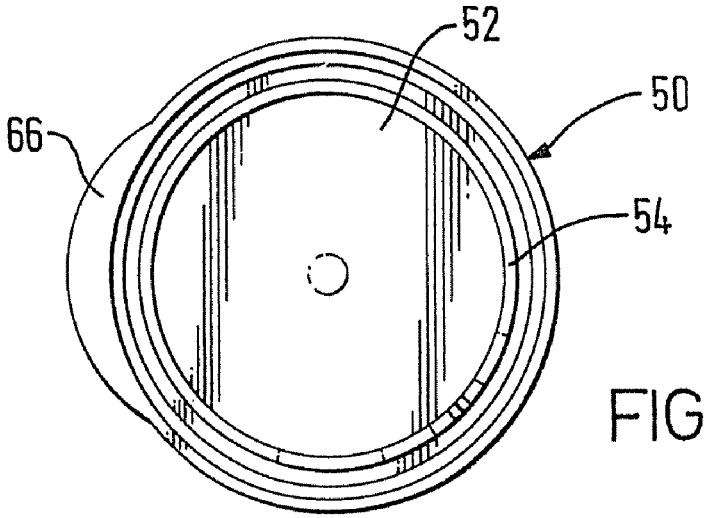
FIG. 10
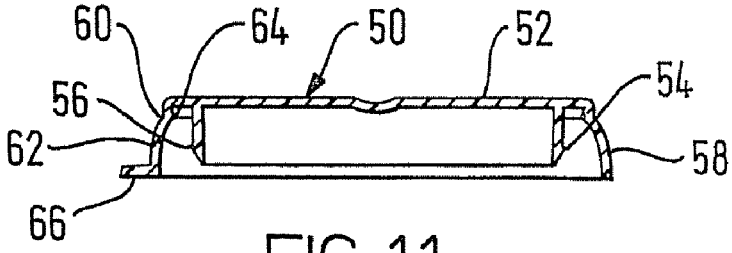
FIG. 11

CAP CLOSURE

REFERENCE TO RELATED APPLICATIONS

This application is a divisional of U.S. patent application Ser. No. 09/701,057, filed Nov. 22, 2000; which is national stage application under 35 U.S.C. §371 of International Application No. PCT/GB1999/01094, filed Apr. 9, 1999; which claims priority to International Application No. PCT/GB98/03433, filed Nov. 13, 1998 and GB 9811308.7 filed May 26, 1998, the entire disclosures of each of which are hereby incorporated by reference herein.

BACKGROUND OF THE INVENTION

The present invention relates to fluid packaging.

The present invention particularly relates to packaging using thin-walled extrusion blow moulded plastics bottles for fluids such as milk, which require to be filled and closed in a resealable manner.

The invention also relates to resealable cap closures for use with plastics bottles or composite material cans, and more specifically to such closures which provide tamper evidence.

In the specification that follows problems of packaging milk are specifically addressed. However, it will be appreciated that other pourable fluids such as fruit juice present similar packaging problems. The present invention is, however, only concerned with fluids that are not required to be packed in a pressurised manner. Accordingly, the problems of packaging carbonated drinks are not addressed.

The present invention in one aspect is also specifically concerned with types of packaging where the weight of the container is an issue and therefore relates specifically to thin-walled blow moulded plastics bottles.

In another aspect, the invention is concerned with resealable cap closures that reveal when tampering has taken place

THE TECHNICAL BACKGROUND

Conventionally, milk has been packaged in cardboard, gable top packs, which are notoriously difficult to open and result in numerous consumer complaints about milk spillage and difficulty in pouring. The fibre carton was only suitable for packaging liquids up to a capacity of 1.5 litres.

In order to resolve these problems blow moulded plastics polyethylene bottles have been used. These bottles are provided with resealable caps. The resealable caps are normally injection-moulded items. Since weight is significant in the packaging of fluids such as milk, these caps must also be light in weight. A weight of 2 to 4 g is usually the maximum that can be tolerated.

There is also a fundamental problem in achieving a good seal between a blow moulded bottle neck and an injection moulded plastics cap. This is because the tolerance of the neck is of the order of 0.3 mm whereas the tolerance of an injection-moulded item such as the cap is 0.1 mm. This means that a proportion of caps will not seal tightly when fitted to their necks. For all designs of caps this results in difficulties of fitting on the production line and, for retailers and distributors, leakage problems. The ultimate consumer may also have difficulty in resealing the bottle or opening it in the first place if the cap is over-tight.

A number of designs of injection moulded caps have been developed in an attempt to address these problems. For example, in a cap design known as a valve seal or pliable seal closure, a plug is provided in the cap which pushes into the neck of the bottle and a multiple start thread is provided on the interior wall of the cap skirt. This type of cap provides a double seal. The plug provides the seal against the inner wall of the neck. The second seal is provided by means of an inwardly projecting ridge above the threads on the inner wall of the cap, which seals against the outer wall of the neck. A pliable pull away ring around the lower edge of the cap can provide tamper evidence for this type of cap. With a cap made of low density polyethylene, it is possible to prise off the cap with the ring attached so that this form of tamper evidence is not very secure.

Another design known as the induction heat seal closure (IHS) provides a foil insert seated into the base of the cap. On the production line the filled bottles with caps fitted are passed through an induction heater, which fuses the foil to the neck of the bottle. When the consumer unscrews the cap the neck of the bottle is still sealed by the foil. This foil seal is pulled off in a separate operation. Severing the seal results in small hairs of the plastics material being raised on the surface of the bottle neck which can inhibit a good seal being formed when the cap is replaced after initial opening. The setting of parameters for the bonding process using an induction heat seal closure is critical in order to achieve a bond which is weak enough to allow the consumer to be able to peel away the foil, yet strong enough to maintain a good primary seal with the container neck. Because the presence of the foil means that no plug can be provided, the susceptibility to leakage in the consumer's home is increased as the resealing of the cap is poor. The cap is also relatively expensive as the provision of the peelable foil insert can add as much as 20% to the cost of the container.

Another set of problems arises from the production line process of filling the bottles and sealing them. Since the maximum linear speed of milk is restricted by the speed at which the milk starts to froth, the rate of filling depends upon the size of the nozzle used to pour the milk into the bottles. The nozzle size is constrained by the dimensions of the neck. For a typical milk container this is 38 mm. Larger necks allow for quicker filling but present greater sealing problems and require larger caps.

In the present context the term blow moulding refers to extrusion blow moulding rather than injection stretch blow moulding. In many modern production lines, a blow moulding plant is adjacent the dairy. This allows the bottles to be formed, filled and sealed in a single continuous production process. The most complex stage in blow moulding is balancing each parison and controlling the material distribution. The parison is then inflated against the wall of a temperature regulated mould solidifying to assume the shape of the mould cavity. In one conventional design of blow moulding machine a block of moulds shuttles between an extrusion station and a blowing station. The number of die-heads provided is generally equal to the number of cavities in the block or some fraction thereof. These die-heads are fed by a head manifold that typically results in an imbalance in the delivery of plastics material to each of the resulting parisons. This process results in difficulties in forming consistently the neck-portion of thin walled containers, achieving at best tolerances of +/−0.3 mm with repeatable accuracy. To achieve good performance with valve seal closures, it is imperative to form a perfectly round neck-bore with a minimum amount of ovality in both bore and threaded portion. Two processes are known to achieve the above result in multi-cavity blow moulding. They are namely a "pull-up" process, which is the lifting of a blow pin through a shear-steel assembly to cut a round bore in a bottle neck, or a "ram-down" process, which is the forcing downwards of a blow pin into a shear steel assembly. The drawback with pull-up is that the neck component is physically weak in its construction leading to poor sealing with valve seal closures as the bore relaxes over time causing leakage. Ram-down however, gives a very rigid neck but this has a weight disadvantage causing ovality of the neck coupled with added cost of material wastage. Ovality causes poor sealing with valve seal closures. Neither of these two processes is suitable for moulding pour-lip features on bottle-necks. With the pull-up finish it is almost impossible to mould a pour-lip feature and with the ram-down finish, it requires significant amounts of extra material and is almost impossible to mould without significant ovality and imperfections in the bore.

The above processes described relate to moulding machinery manufactured by companies such as Uniloy, Techne and Bekum, for example.

An alternative type of machine made by Graham Engineering and Uniloy, which is particularly suitable for on-site blow moulding plants, uses a process which is commonly referred to as wheel blow moulding. Unlike the previous processes described, the wheel produces only one parison at a time extruded from a single die-head. The mould blocks are mounted on a rotary wheel structure and pass over the parison closing as the wheel rotates. A needle assembly pierces the parison and inflates the plastics until it solidifies against the wall of the temperature regulated moulds. Wheel blow moulding gives a high level of control in material distribution in containers produced in this way. The set up time for such a machine is significantly reduced, as only one die-head needs to be set up.

Where the inner wall of the neck provides one part of a seal, it may be necessary to provide a separate finishing station where the neck is either reamed or punch finished. The finishing step may produce swarf, which results in the risk that the swarf could enter inside the bottles and make them unsuitable for immediate filling.

For products such as milk where large quantities are required to be distributed through the retail chain, it is highly desirable to minimise the weight of the packaging. This has resulted in larger containers and thinner walls. Typical wall thicknesses for blow moulded high-density polyethylene (HDPE) are 0.4 to 0.6 mm. This results in a 4 pint (2.27 litres) bottle having a weight of around 40 g. Therefore any solution to the technical problems described must not increase the weight of the bottle and preferably would allow weight reduction.

PRIOR ART

For cardboard cartons it has been proposed to provide a separate spout assembly which is secured to the carton. An example is described in WO-A 96/14249 (Capitol Spouts Inc.). This spout includes a cap and an integral inner membrane seal and is assembled to an outer wall of a filled carton. The container may have a scored portion so that when the inner membrane seal is removed, it brings with it the scored portion of the container wall creating an opening through which the contents of the container can reach the spout. This assembly is not suitable for use with a plastics container where it would be impractical for the user to tear an opening in a plastics walled container. The cardboard carton will typically have a continuous inner lining. This type of spout must be fitted to the carton prior to filling and is not used for filling the container.

GB-A-2 108 464 (Container Corporation of America) describes an end closure arrangement wherein a membrane is sandwiched between and used to bond rim portions of a container body and end member to each other. The membrane has heat activatable sealing materials on both sides such as polyethylene, polypropylene or other similar types of material. The reader is told to use this type of closure with a container, which may be of all plastics, or a combination of paperboard and plastics materials. The exact method of production of the container body and end member is not further described. The specification is also silent as to the method of filling the resulting container. The specification particularly suggests use with a cylindrical cardboard container. Such containers would normally be filled from the base once the openable end had been completed and sealed.

U.S. Pat. No. 4,815,618 (Gach) shows a tamper indicating closure for a bottle designed for dry contents. A base section has a skirt, which engages with the neck of the bottle and defines a spout. A foil is interposed between the neck of the bottle and an adjacent surface of an upper part of the base. A pull ring is attached to a disc, which is connected to the opening in the upper part of the base by means of breakable webs. The disc is bonded to the foil. Pulling on the pull ring, which tears the foil away from the spout, opens the closure. In an alternative embodiment of the Gach invention, the disc is not joined to the base section and the foil is provided with a circumferential score line to facilitate tearing at the edge of the inner surface of the spout. In either embodiment a clean opening is unlikely to be produced. This would not be a problem when the bottle is used for tablets or the like but a torn foil edge within the spout is unsuitable for the pouring of liquids. The material of the bottle is not disclosed.

Although these documents are referred to as the most relevant prior art they do not represent a natural starting point for those seeking to solve the technical problems described in relation to thin-walled plastics bottles, in which the teaching has hitherto been directed exclusively at integral formation of the bottle body and neck.

Therefore, although it is known to produce a separate component defining a neck as in GB-A-2 108 464, the possibility of using this approach to solve the long present technical problems of effective reclosable sealing of thin-walled blow moulded plastics containers for fluids had not hitherto been appreciated and cannot therefore be regarded as obvious.

SOLUTION OF THE INVENTION

In accordance with the present invention there is provided a thin-walled plastics bottle comprising an extrusion blow moulded body, and an injection moulded neck and cap assembly adapted to be fused together with the body after the body has been filled with a fluid, and wherein the cap is fitted to the neck in order to provide a leak-free resealable closure.

This solution has numerous advantages. The neck and cap will fit together in a reliable sealing manner as both components are formed by the same manufacturing technique, preferably injection moulding, which means both components will be subject to the same tolerances. The neck and cap assembly can be supplied from a separate factory, which can produce them in hygienic circumstances. Any of the pre-existing cap designs can be employed.

The body to which the neck and cap assembly is fitted can have a relatively wide mouth through which it can be filled, thus increasing the filling speed.

In a preferred embodiment of the closure, the cap comprises a cover plate and a depending skirt, and the base has a weakened annular recess which is concealed by the skirt of the cap when the closure is sealed. With this construction, any attempt to prise the base from the neck of the bottle results in destruction of the cap closure as the levering force results in the base severing at the weakened recess.

Relative to the prior art defined in Gach which describes a bottle comprising a body having an open mouth, a neck and a cap assembly comprising a skirt adapted to engage over the mouth and defining a pour spout and having a pull ring coupled to a removable part held within a base of the neck which seats against an upper surface of the mouth; and a foil interposed between the surface and the base and fused with both such that removal of the pull ring and removable part removes at least part of the foil and opens the spout; the present invention is characterised in that the removable part comprises an annular flange separated from a remainder of the base by means of a frangible valley defining a plurality of depending teeth each having a saw tooth profile inclined inwardly to a centre of the base such that on removal of the pull ring the foil is torn by the teeth.

The use of an annular flange rather than a disc as in Gach allows the neck assembly to be injection moulded in one piece by means of a mould tool which can be separated along an axis passing through a centre of the pull ring and flange. The saw tooth teeth tear the foil cleanly ensuring that it is removed with the pull ring allowing fluid to flow freely out of the spout.

In addition, the foil is used to seal the mouth at the same time as the neck and cap assembly is fused to the mouth in a single heat sealing operation. This results in more reliable sealing of the filled bottles avoiding any leakage during the distribution and retailing cycle.

The closure described is suitable for use with thin-walled plastics bodies and composite cardboard cans or other containers of any material to which a base of the closure can be fitted Other aspects and features of the invention are set out in the claims.

The term thin-walled as used herein is intended to refer to wall thicknesses of 2 mm or less and preferably within the range 0.1 mm to 1.0 mm. A container having a wall thickness of less than 0.1 mm is unlikely to have the necessary structural integrity to hold its shape when filled with fluid. For a milk container of up to 6 pints (3.41 litres) capacity, a thickness of 0.4 to 0.6 mm is appropriate.

BRIEF DESCRIPTION OF THE DRAWINGS

In order that the invention may be well understood, an embodiment thereof will now be described, by way of example only, with reference to the accompanying drawings, in which:

FIG. 9 shows a perspective view from above the neck of FIG. 5;

FIG. 10 shows an underside plan view of a cap; and

FIG. 11 shows a section through the cap of FIG. 10.

DETAILED DESCRIPTION OF THE INVENTION

A bottle body 2 has a mouth 4, which is integrally formed in a single blow moulding operation. The remainder of the body shape has not been shown as it may take any suitable form. For example it may be square, rectangular or round in section and may have an integral handle formed as part of the body shape.

Figure 1:
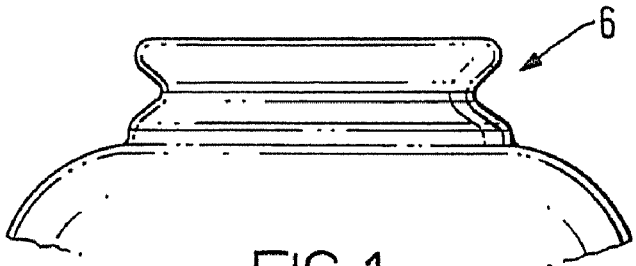
FIG. 1 shows a side view of a mouth of a first embodiment of a bottle body.
Figure 4:
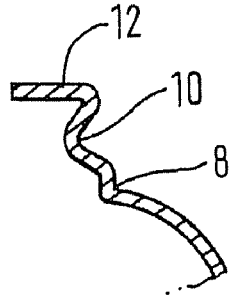
FIG. 4 shows a partial section through a side wall at a mouth of the bottle body of FIG. 1.
Figure 2:
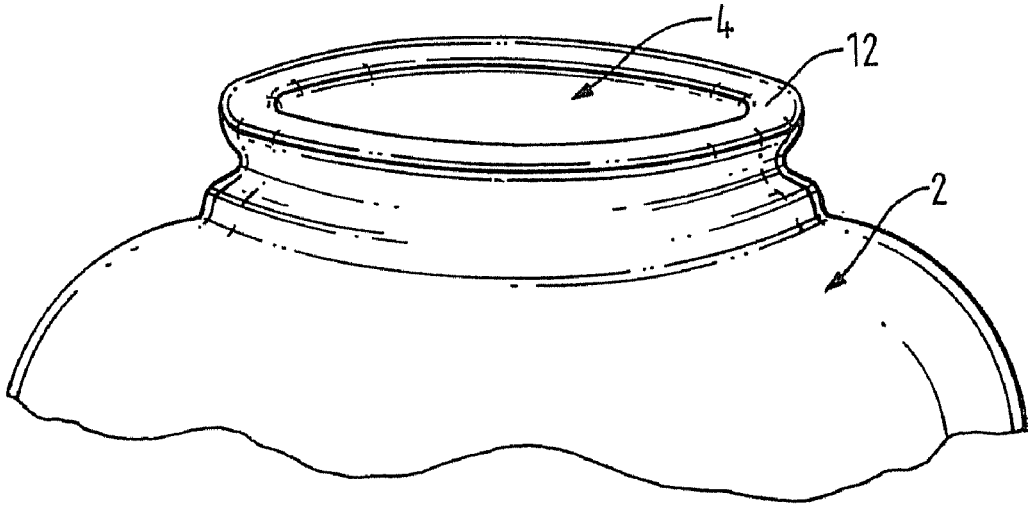
FIG. 2 shows a perspective view of a mouth of the bottle body of FIG. 1.

The profile 6 of the mouth is best shown in FIG. 4 and comprises a vertical wall 8 adjoining an indented recess 10 which merges into an inwardly directed horizontal seating flange 12. The purpose of the recess 10 is to give the mouth profile more rigidity and resistance to compression when top loaded during the subsequent operations to attach a neck and cap assembly. It is also used to locate a mouth of the neck assembly when applied in the filling process.

Figure 3:
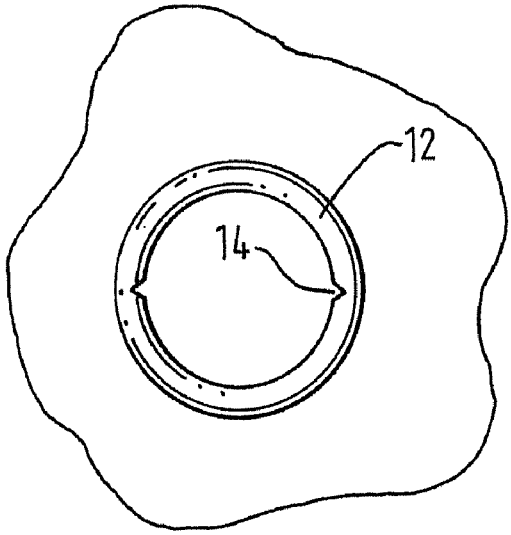
FIG. 3 shows a top plan view of a mouth of the bottle body of FIG. 1.

The body 2 with its shaped mouth profile 6 is formed by the mould against which a parison of high density polyethylene or other suitable plastics is inflated in any appropriate conventional extrusion blow moulding process. If the blow moulding takes place on a rotary machine then nicks 14 in the flange 12 as shown in FIG. 3 will be formed. These are usually removed in second stage trimming by either reaming or punching after any dome of the parison is guillotined from the container to leave the open mouth 6. This invention removes the necessity for this trimming and finishing. It is not necessary to remove these or any other irregularities in the internal profile of the mouth for use in the fusing of the neck to the container profile 6.

Figure 5:
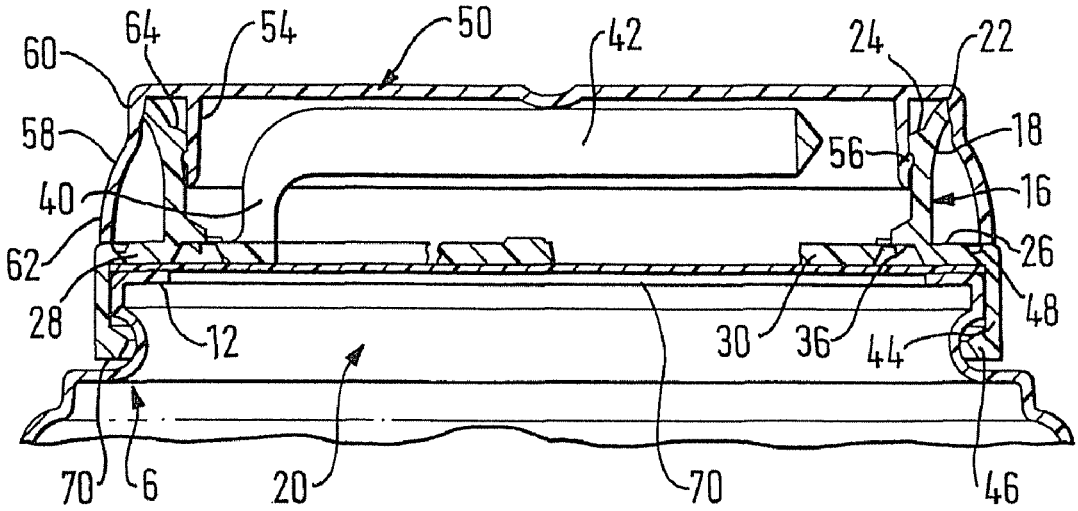
FIG. 5 shows a section through a neck and cap assembly assembled to a second embodiment of a bottle body.
Figure 6:
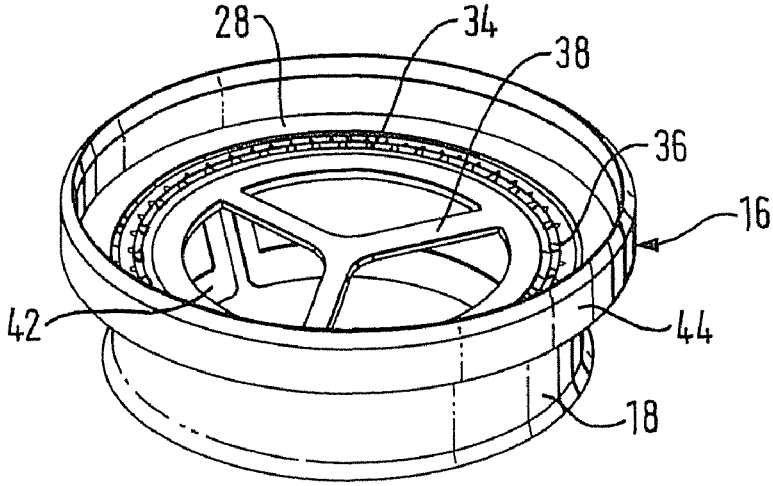
FIG. 6 shows a perspective view from below of a neck shown in FIG. 5.

The mouth of the bottle as illustrated in FIG. 5 has a modified profile from that shown in the embodiment of the bottle illustrated in FIGS. 1 to 4. The mouth profile of the bottle shown in FIG. 5 defines a narrow shelf 15 around the mouth above the recess 10. This shelf 15 allows a neck of a neck and cap assembly to be perched on the bottle during the assembly process before the neck has been fully engaged with the bottle body. The presence of the shelf 15 allows the bodies with necks perched on them to be moved along an assembly line without the neck and cap assemblies falling off.

A neck assembly 16 is shown in the FIGS. 5, 6, 7 and 9. The neck assembly comprises an annular side wall 18 supported on a base 20 which fits to the bottle body and which in this embodiment comprises a flat portion covering the mouth of the bottle and a skirt which couples to the neck profile. It will be appreciated that when the closure is used with other types of container, other designs of base will be needed. For example, the base to be used with a composite container can end may use a flange which projects beyond the flat portion covering the mouth of the opening in the can. Such a flange could be connected to the cardboard material by a fusion process or by any other known means.

The side wall 18 forms a pour spout for the container and terminates in a projecting pour lip 22, which is slightly tapered towards the pouring edge. In the illustrated embodiment the annular side wall 18 defines a slight outwardly projecting curved profile which tapers towards the pouring edge and terminates in a point where outer and inner surfaces of the wall converge. The profile of the point must be capable of being moulded in a repeatable manner. A precise point produces exceptionally good control and allows a very thin column of liquid to be poured with control from the spout. Such a precise point cannot be blow moulded without weight or cycle time penalties or both and this therefore represents a significant improvement relative to blow moulded pour lips. On the inner surface of the annular side wall 18 there is an annular bead 24 set below the pour lip. This annular bead 24 is intended to interlock with a corresponding bead 56 on a plug of a cap in a manner to be described in more detail later.

Opposite the pour lip, the side wall 18 merges with the flat portion 26 of the base 20. This flat portion 26 covers the mouth of the bottle body and comprises an outer annular flange 28 projecting outwardly from the side wall 18 and an inner annular flange 30. The inner flange 30 is separated from the rest of the neck assembly by an annular gap which is bridged by a plurality of spaced bridges 34 which join the inner annular flange 30 to an inner surface of the side wall 18. The gap with bridges 34 forms a frangible region 32. The bridges 34 are equally spaced relative to each other throughout the frangible region. The bridges 34 are tapered in their plan profile, which can be most easily seen in FIG. 8. The bridges 34 are at their widest where they join the inner annular flange 30 and at their narrowest where they join the outer annular flange 28 of side wall 18. This ensures that all the bridges 34 will break adjacent the outer annular flange 28 at their weakest portion. In an alternative embodiment, the frangible region could be provided by means of a thin skin of plastics. However, the use of the bridge structure reduces the removal force and makes it more controllable by adjustment of the number of bridges and the narrowness of the junction between each bridge and the side wall.

As seen in FIG. 5, the external edge of the inner flange 30 and the internal edge of the outer flange 28 have inclined side walls which together with the gap and base of the side wall 18 define a valley within which the frangible region 32 is located.

Figure 7:
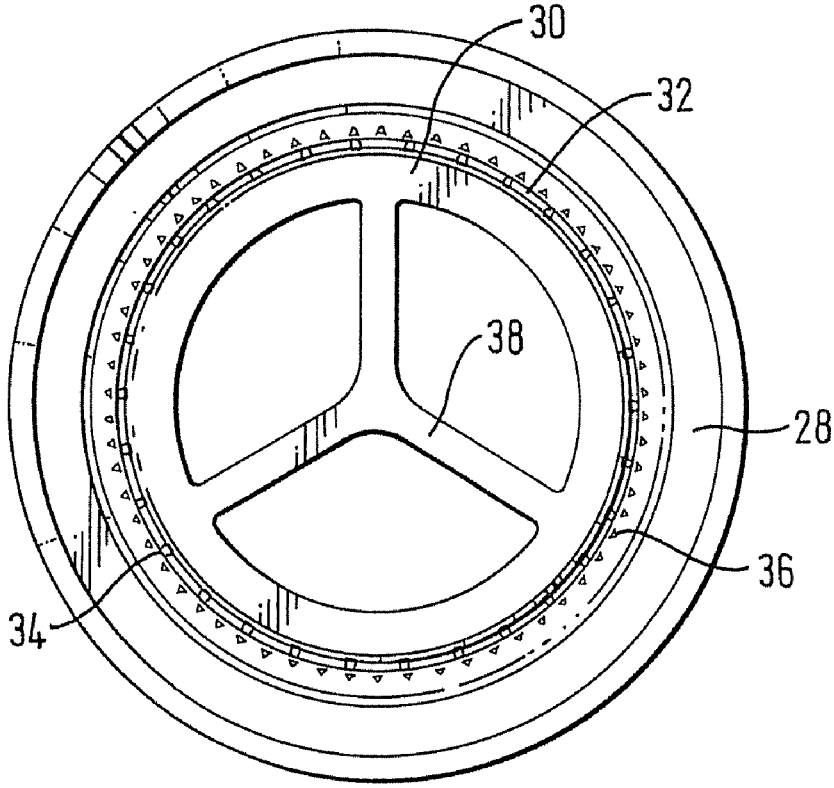
FIG. 7 shows a plan view from below of the neck.
Figure 8:
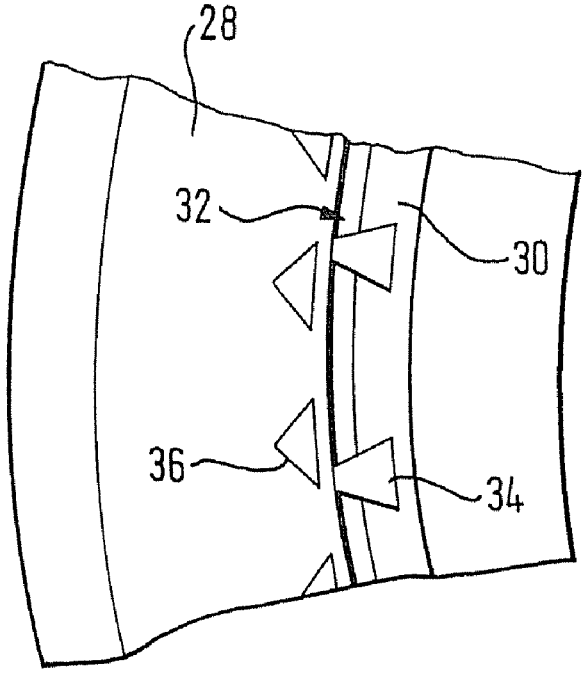
FIG. 8 shows an enlarged view of a frangible portion of the neck of FIG. 7.

A series of spaced pointed teeth 36 depend downwardly from the floor of the valley. Each tooth 36 as shown in FIGS. 7 and 8 is triangular in plan and has a saw-tooth profile section as shown in FIG. 5. The teeth 36 are inclined inwardly to the centre of the base. It will be appreciated that the pitch of the teeth may be varied from that shown in the drawings. In an embodiment when the frangible region is provided by a thin plastics skin, the teeth may be located on that skin.

The inner flange 30 has three thin sprues 38 extending from its inner surface to a centre point. This construction allows the neck assembly 16 to be injection moulded from a central point which provides for a more uniform distribution of plastics material during the moulding process. If side injection is used, no sprues are necessary.

An inner face of the inner flange 30 supports two closely spaced legs or stalks 40 formed at either side of one of the sprues 38. The stalks rise and bend over and curve round until they merge to form a pull ring 42. The pull ring 42 is formed with a teardrop cross sectional profile to facilitate removal from the moulding tool. The user's finger is inserted into the ring where force can be applied opposite the legs 40. The force causes the frangible portion to sever simultaneously in both directions away from the attachment point to open the closure. This presence of two stalks reduces the risk of the pull ring 42 being broken away from the flange 30. Preferably the inner lower edge of the pull ring 42 has a curved rather than a sharp edge in order to prevent the ring cutting into the user's finger during the pulling operation.

A skirt 44 extends around the exterior of the side wall 18 and depends from the outer edge of the outer flange 28 of the base 26. The skirt 44 terminates in an inwardly projecting rib 46 in order to engage with a recess 10 of the profile 6 of the mouth of the bottle body 2.

In the upper surface and towards the outer edge of the outer flange 28 an annular weakened recess 48 is formed. The recess 48 provides a point of weakness so that if an attempt is made after the container has been assembled to prise off the neck assembly 16 by use of levering action between the skirt 44 and the wall of the bottle 2, the skirt will separate from the flat portion 26 indicating that the closure has been tampered with.

In an alternative embodiment (not shown), the annular side wall 18 could be provided with a shoulder so that the pour spout of the neck which is closed by a cap 50 may be of smaller diameter than the mouth of the bottle body.

The design of the side wall and pour spout of the neck assembly 16 is dependent on the type of cap that will be used to complete the neck and cap assembly. The cap 50 in the illustrated embodiment is of the valve seal type, which provides a push, fit. It will be appreciated that the neck can be adapted for use with screw on caps and for this purpose may have a thread or multi-start threads formed in an outer surface of the side wall 18 to engage with a screw thread formed in an inner wall of the co-operating cap.

The cap 50 as shown in FIGS. 10 and 11 is an injection moulded component comprising a cover plate 52 with a depending inner cylindrical plug 54. The cylindrical plug 54 extends vertically downward from the cover plate 52. An annular bead 56 is formed around an external surface of the plug. The bead 56 engages with the bead 24 on the annular side wall 18 of the neck assembly 16 to retain the cap 50 on the neck. Below the bead 56 the plug wall tapers inwardly to facilitate insertion into the mouth of the neck.

A depending outer skirt 58 is joined to the edge of the cover plate 52. The skirt 58 has an essentially vertical region 60 adjacent the cover plate 52 which merges into a flared region 62. The free edge of the flared region 62 opposite the cover plate 52 aligns itself with the edge of the neck skirt 44 outwardly of the weakened recess 48 so that there is an unbroken profile of the closed neck and cap assembly. The depth of the skirt 58 is such that the edge just reaches the upper surface of the flat portion 26 of the neck assembly 16 when the cap is fully engaged with the neck assembly 16. The clearance of 0.5 mm is preferred in the neck and cap assemblies before they are assembled to bottle bodies.

The profile of the flared region 62 allows the skirt to flex when subject to downward pressure applied to the cap during assembly. It will also be appreciated that the alignment of the skirt 58 with an outer edge of the neck assembly ensures that downward forces applied to the cap are transmitted through the skirt 58 to the skirt 44 of the neck assembly into the body of the bottle 2. This minimises the risk of damage to the pour spout and the valley structure during assembly of the neck and cap assembly and also during resealing of the bottle.

An annular bead 64 is situated on the inside of skirt 58 of the cap close but spaced from the top of the vertical region 60. The purpose of the bead 64 is to provide a seal with the underside of the pour lip 22.

The cap 50 is snap fitted onto a mouth of the pour spout. It is sufficiently flexible not to deform the pour lip during the sealing and resealing operation. The slightly curved profile of the annular side wall 18 maintains sufficient rigidity which guides the plug of the cap when the cap is snap fitted. With the design illustrated in FIG. 5 there are two sealing points between the cap and the neck. The first sealing point is between the annular bead 64 and an underside of the pour lip. The second sealing point is between the co-operative annular beads 24, 56 on the side wall 18 and the plug 54 respectively. When the cap engages with the neck, the flexing of the annular beads as they come into contact produces an audible click which indicates that a seal has formed and the cap is properly located. This two point sealing is particularly efficient at eliminating the risk of leaks. Because both the neck assembly and the cap are injection moulded components, they can be moulded accurately. This ensures that a good, repeatable engagement can be provided.

A horizontal tab 66 projects from a portion of the lower edge of the skirt 58 as seen in FIGS. 10 and 11. The tab 66 allows the user to lever the cap away from the neck when opening the container. The tab 66 in plan view has a curved profile providing a relatively large area of attachment to the skirt 58. Protrusion of the tab is kept to the minimum necessary for it to be lifted by fingertip. The tab must be relatively inflexible. Providing a relatively large area of attachment of the tab to the skirt reduces flexibility. Since the tab is relatively inflexible, when it is engaged by fingertip, it is easier for the user to pop the cap off the neck of the bottle by a simple pivoting or levering operation.

The use of a cap with a skirt that covers the entire upper surface of the neck assembly allows the weakened recess 48 that provides for tamper destruction of the neck assembly to be concealed when the bottles are on display. If any attempt is made to lever the skirt away from the bottle the closure will be so damaged that store personnel will immediately be alerted to the risk that attempt are being made to tamper with the contents of the bottles. This type of tamper evidence is believed to be more effective in terms of discouraging attempts at tampering and provides greater consumer confidence.

In order to minimise the weight of the cap, the plastics of which it is moulded may be foamed. This would allow it to be substantial enough for ease of handling yet lightweight to minimise overall weight and accordingly transport costs.

The neck is assembled to the body with an intermediate sealing foil 70. The foil 70 may be a polymer foil or a polymer foil laminated to an aluminium foil or aluminium. The foil is selected so that it is capable of being bonded on both sides and torn with minimal user force. Any of the materials traditionally used for providing a heat-seal foil in existing plastics milk bottles may be employed. A thinner foil may be necessary than has been used in prior art pealable seals in order to facilitate tearing. Any layer of polymer must also be sufficiently thin so as not to inhibit the tearability of the foil. A foil of aluminium of thickness between 12 and 25 microns with polymer layers on both sides of between 15 and 30 microns or less will tear easily in use while maintaining the necessary seal within the cap. Where an aluminium laminate is used small perforations may be provided in the aluminium layer to allow the polymer to pass through during the heat sealing process and thereby form a bond between the flange 12 of the bottle body and the adjacent surface of the base 26 of the neck. The foil 70 is preferably supplied already bonded to the base of the neck and cap assembly. The foil neck and cap assemblies are then delivered to a filling hall.

During the heat sealing of the foil to the lower face of the flat portion 26, there will be a certain flow of plastics material into the valley between the inner and outer flanges 30, 28. The width of the valley is critical, as this flow of material must not submerge the teeth 36. During the induction heating the annular side wall 18 also collapses to some extent and the edge of the skirt 58 of the cap 50 will now come into contact with an upper surface of the flat portion 26.

Both the neck and cap are preferably injection moulded plastics components. Since they are both manufactured by the same method to the same tolerances the seal between neck and cap will be good. The neck and cap assemblies may by supplied to a bottling plant ready assembled, tested and sterilised.

The details of the injection moulding process and the detailed design of the tool will not be described herein as they will be readily apparent to those skilled in the art.

Filling Process

The described bottle and neck and cap assembly may be used in various ways in a filling hall of bottling plants. The bottle bodies may be supplied to the plant ready formed but this results in the need to transport large volumes and it is preferable to form the bodies in a blow moulding plant adjacent the dairy so that they can be formed and filled in one continuous production line. The absence of any requirement for further trimming and finishing the interior of the mouth of the body makes this design of bottle particularly suitable for such a process.

In a preferred embodiment of the process, the bottle bodies are blow moulded using a rotary machine having a series of moulds adapted to pass beneath a single die-head for the supply of a predetermined amount of plastics material to form a parison which is subsequently inflated to form the bodies. Such rotary machines are commercially available and require only the modification of the mould to define the required mouth profile 6 instead of a more conventional neck.

The bodies are filled through the mouth with the fluid such as milk.

In aseptic packaging the foil 70 will be sprayed with a sterilising solution such as a water/paracetic acid mixture in order to sterilise the face of the foil which will be adjacent the milk in the finished container. Such a sterilising solution is marketed under the trademark OXONIA. Alternative sterilising methods such as irradiation may be employed but are at this time more expensive.

The sterilised and foiled neck and cap assemblies are supplied through a chute to a pick and place mechanism, which orients each neck and cap assembly and places it on a filled bottle body. The skirt 44 clips over the profile 6 sandwiching the foil 70 between the two components. In the next step, the neck assembly 16 is bonded to the horizontal flange 12. Preferably a chute of the pick and place mechanism contains an induction coil so that as each assembly is pressed onto the body induction heating is applied to bond the foil to the body. To form an effective bond some pressure may be required to hold the body and neck firmly together during this step. The induction heating and bonding may alternatively be carried out at a separate station downstream of the pick and place mechanism. ENERCON ABLBRANDT supplies suitable induction heating machines.

Rotation generated friction heating could also be used to fuse the body and neck and cap assembly without the presence of an intervening foil.

Opening Process

When the user receives the filled bottle, the first step is to remove the cap 50 by lifting it at the tab 66 to release the seal around the pour lip and to lever the cap off. This exposes the pull ring 42. The user inserts a finger into the centre of the ring and pulls the ring upward about an axis defined in the plane of the base 20 perpendicular to the legs 40. This rotational movement stretches the foil 70 against the longer outer face of the saw tooth profiled teeth 36. The points of the teeth tear the foil 70 as the pull ring is lifted. The tear in the foil proceeds in a simultaneous clockwise and counter-clockwise direction until the tears meet opposite the legs 40. The lifting of the ring also causes the bridges 34 in the frangible region 32 to break. That part of the foil 70 that is fused to the flange 30 is pulled away and discarded with it.

The fluid may then be poured out of the exposed opening over the pour lip 22. When the user wishes to re-seal the bottle the cap 50 is replaced by simply pushing the plug 54 into the mouth of the neck and pressing down until the beads 24, 56 interlock. This sealing is signified by an audible snap.

Modifications of the Cap Closure

It will be appreciated that the same design of cap closure can be used with containers other than bottles, for example composite cartons. In such an application, the base 20 would need to be adapted to fit to the composite carton end. This may require an annular flange instead of the depending skirt 44.

The flange could then be fused or otherwise connected to the carton. In all other respects the structure of a closure would remain the same.

The invention claimed is:

1. A closure suitable for use with a thin-walled plastics bottle having a body, the closure comprising:

a foil; and an injection moulded neck and cap assembly adapted to be fused together with a body after the body has been filled with a fluid, wherein the cap is fitted to the neck in order to provide a leak free resealable closure, and wherein the foil is interposed between the body and the neck and cap assembly when the neck and cap assembly is fitted to the body, and the neck and cap assembly comprises a base, a removable annular flange connected to a pull ring and secured to the foil, the removable annular flange being separated from the base by a frangible region, and a plurality of depending teeth each having a saw tooth profile inclined inwardly to a centre of the base formed in the base in or adjacent to the frangible region such that on removal of the pull ring the foil is torn by the teeth.

2. A closure as claimed in claim 1, wherein the cap comprises a cover plate and a depending skirt and the base has a weakened annular recess, which is concealed by a skirt of the cap, when the closure is sealed.

3. A closure as claimed in claim 1, wherein the pull ring is supported above the annular flange by means of a pair of adjacent spaced legs to promote symmetrical tearing of the foil.

4. A closure as claimed in claim 1, wherein the foil is a tearable aluminium foil coated with a fusible polymer material on both sides.

5. A bottle comprising:

a body having an open mouth;

a neck and cap assembly comprising a skirt adapted to engage over the mouth and defining a pour spout and having a pull ring coupled to a removable part held within a base of the neck which seats against an upper surface of the mouth; and a foil interposed between the surface and the base and fused with both such that removal of the pull ring and removable part removes at least part of the foil and opens the spout;

characterised in that the removable part comprises an annular flange separated from a remainder of the base by means of a frangible valley defining a plurality of depending teeth each tooth having a saw tooth profile inclined inwardly to a centre of the base such that on removal of the pull ring the foil is torn by the teeth.

6. A closure for use with a container having a body comprising:

an injection moulded neck and cap assembly adapted to be fused together with the body after the body has been filled with a fluid, wherein the cap is fitted to the neck in order to provide a leak free resealable closure, and wherein a foil is interposed between the body and the neck and cap assembly, and the neck and cap assembly comprises a base fitted to the body, a removable annular flange connected to a pull ring and secured to the foil, the removable annular flange being separated from the base by a frangible region, and a plurality of depending teeth each tooth having a saw tooth profile inclined inwardly to a centre of the base formed in the base in or adjacent to the frangible region such that on removal of the pull ring the foil is torn by the teeth.

* * * * *

UNITED STATES PATENT AND TRADEMARK OFFICE

CERTIFICATE OF CORRECTION

PATENT NO. : 7,931,163 B2
APPLICATION NO. : 12/505227
DATED : April 26, 2011
INVENTOR(S) : Von Spreckelsen et al.

It is certified that error appears in the above-identified patent and that said Letters Patent is hereby corrected as shown below:

On the front page, field (30), Foreign Application Priority Data, should be added as follows:

-- (30) Foreign Application Priority Data

Nov. 13, 1998 (GB).....PCT/GB1998/003433
May 26, 1998 (GB).....9811308.7 --

Signed and Sealed this
Twenty-ninth Day of November, 2011

David J. Kappos

David J. Kappos
*Director of the United States Patent and Trademark Office*